US007245265B2

(12) United States Patent
Kienzle et al.

(10) Patent No.: US 7,245,265 B2
(45) Date of Patent: Jul. 17, 2007

(54) PARABOLIC ANTENNA OF A LEVEL MEASURING INSTRUMENT AND LEVEL MEASURING INSTRUMENT WITH A PARABOLIC ANTENNA

(75) Inventors: Klaus Kienzle, Zell (DE); Daniel Schultheiss, Hornberg (DE); Josef Fehrenbach, Haslach (DE)

(73) Assignee: Vega Grieshaber KG, Wolfach (DE)

( * ) Notice: Subject to any disclaimer, the term of this patent is extended or adjusted under 35 U.S.C. 154(b) by 0 days.

(21) Appl. No.: 11/182,739

(22) Filed: Jul. 18, 2005

(65) Prior Publication Data

US 2006/0017640 A1 Jan. 26, 2006

(30) Foreign Application Priority Data

Jul. 20, 2004 (DE) ..... 10 2004 035 083

(51) Int. Cl.
*H01Q 19/14* (2006.01)

(52) U.S. Cl. ..... 343/781 R; 343/779

(58) Field of Classification Search ..... 343/775, 343/781 R, 779, 781 P
See application file for complete search history.

(56) References Cited

U.S. PATENT DOCUMENTS 4,263,599 A 4/1981 Bielli et al.
5,907,310 A * 5/1999 Seewig et al. ..... 343/786
5,926,152 A 7/1999 Schneider
6,233,479 B1 * 5/2001 Haddad et al. ..... 600/430
6,429,826 B2 * 8/2002 Karlsson et al. ..... 343/781 P
2001/0005180 A1 6/2001 Karlsson et al.

FOREIGN PATENT DOCUMENTS

DE 195 00 324 C1 5/1996
JP 60004310 A 1/1985
JP 61133705 A 6/1986
JP 63123204 A 5/1988
WO 98/06147 A1 2/1998

OTHER PUBLICATIONS

XP 000073936: Westerlind, H.G., "Level Gauging By Radar", *Advances in Instrumentation and Control*, vol. 44, part 4, pp. 1385-1396, (1989).

* cited by examiner

*Primary Examiner*—Hoanganh Le
(74) *Attorney, Agent, or Firm*—The Nath Law Group; Jerald L. Meyer; Stanley N. Protigal

(57) ABSTRACT

This invention concerns a parabolic antenna with a parabolic reflector (2) having a parabolic reflector rim (20), a collar (9), which is positioned on the parabolic reflector (2), in particular on the parabolic reflector rim (20) and which has an outside collar rim (90), and having an exciter and/or a receiver (3), such that the exciter and/or receiver (3) are/is located in the axial direction (X) partly within the parabolic reflector rim (20) and partly outside thereof.

11 Claims, 2 Drawing Sheets

PARABOLIC ANTENNA OF A LEVEL MEASURING INSTRUMENT AND LEVEL MEASURING INSTRUMENT WITH A PARABOLIC ANTENNA

This invention refers to a parabolic antenna of a level measuring instrument with the major conceptual characteristics of claim 1 and/or to a level measuring instrument with such a parabolic antenna.

Level measuring instruments with a level measuring instrument parabolic antenna, which operate with radar waves or microwaves in order to determine the level of a medium in a container are generally known. The parabolic antenna of such a level measuring instrument is located on the interior side of a container wall.

Figure 2:
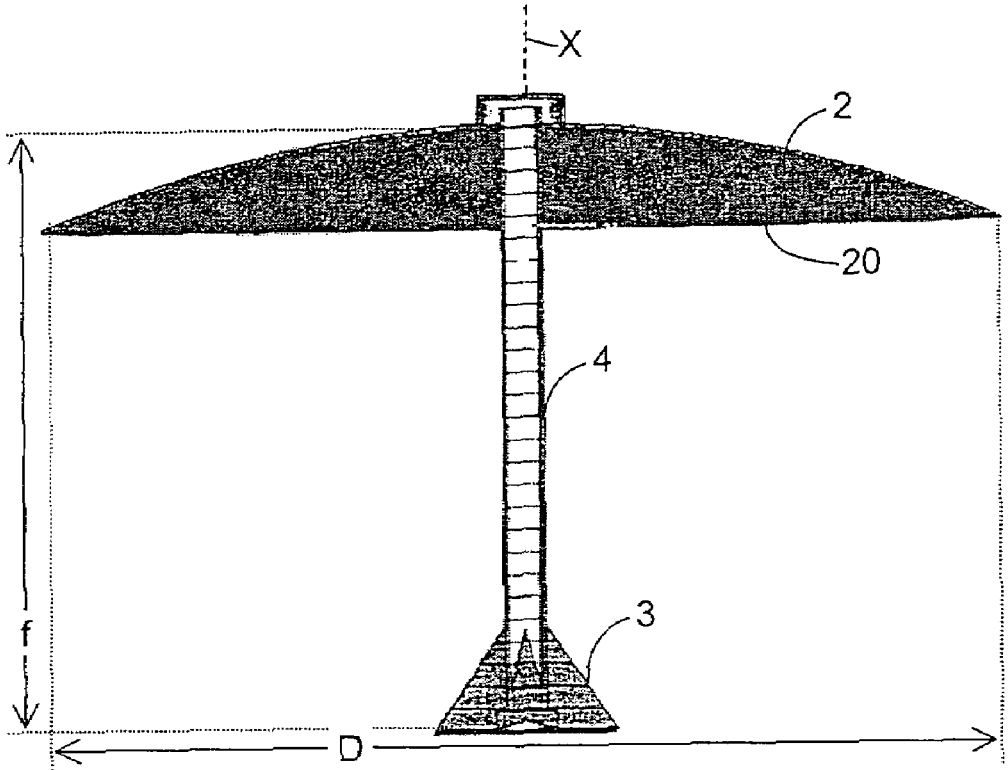

As shown in FIG. 2, such a parabolic antenna consists of a parabolic reflector 2 and an exciter and/or receiver arrangement 3, which are located at the focal point of the parabolic reflector as a combined structural group. The parabolic reflector 2 has a parabolic reflector rim 20. The parabolic reflector 2 has a high focal length f to diameter D ratio, i.e. this is a flat parabolic reflector 2. For example, the focal length f to diameter D ratio is 0.6. The exciter 3 is located far outside of the interior space of the parabolic reflector 2 defined by the parabolic reflector rim 20 by means of a tubular conductor 4.

An advantage of such a design is the small irradiation loss, which allows for an optimum antenna gain.

The disadvantage of such a design is the over-irradiation of the parabolic reflector 2, which leads to unwanted side lobes or back lobes. These side lobes and back lobes result in interfering reflections from container walls and the cover of the container into which the parabolic reflector 2 is built. In addition, a long exciter system can be sensitive to vibrations.

Figure 3:
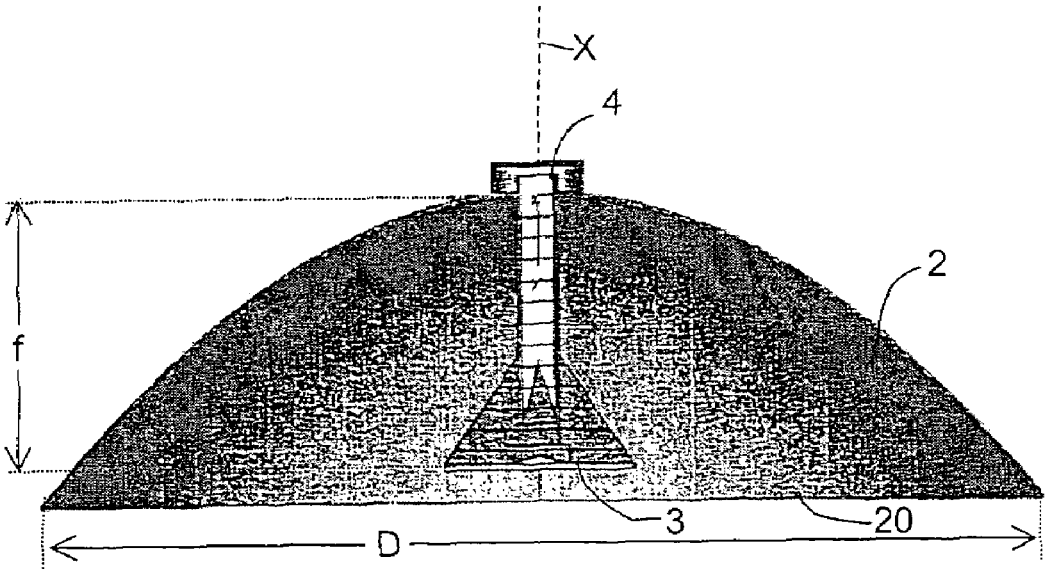

A parabolic antenna with a parabolic reflector 2, within which an exciter 3 is located, as shown in FIG. 3, is additionally generally known. The parabolic reflector 2 of such a parabolic antenna has a small focal length f to diameter D ratio, for example, f/D=0.2. This means that the parabolic reflector 2 is very deep, and the exciter 3, which is located within the parabolic reflector 2 by means of a tubular conductor 4, is positioned at the same level as the parabolic reflector rim 20 or even axially within the parabolic reflector 2.

It is an advantage of such an arrangement that the exciter system and/or the exciter 3 are/is protectively located within the parabola or the parabolic reflector 2. In addition, over-irradiation of the parabolic reflector 2 is not possible. However, such a parabolic reflector 2 is disadvantageously not completely irradiated, which leads to a lower antenna gain.

Figure 4:
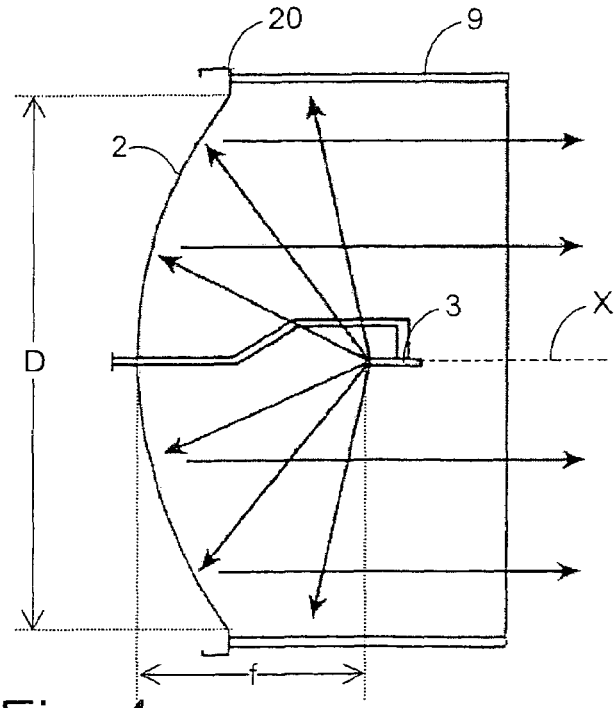

Parabolic reflectors for radio telecommunication technology with a cylindrical extension as shown by FIG. 4 are uncharacteristically known from "Dr. Daniel Wojtkowiak, Consider Antenna Options for Minimum Interference, Microwaves & RF, May 2004, pages 76-86". This parabolic antenna is a parabolic reflector 2 with a relatively high f/D ratio. The disadvantage of such an arrangement would be the over-irradiation of the parabolic reflector 2, which leads to unwanted side lobes or back lobes. To avoid side and back lobes, a collar is placed on the rim 20 of the parabolic reflector, which collar extends circumferentially in the axial direction, parallel to a central parabolic mirror axis X. The collar then extends from the parabolic reflector rim 20 to a distance such that the exciter 3 is within a space enclosed by the collar 9. The interior surface of the collar 9, i.e. the surface facing the exciter 3, is coated with an absorbing foam material or consists of such a material, so that waves impinging on the collar 9 are absorbed.

Compared with a parabolic antenna in accordance with FIG. 2, this has the advantage that side and back lobes are avoided. However, wave components, which are emitted from the exciter 3 into the lateral region of the parabolic reflector, are lost.

It is the object of this invention to propose an alternative level measuring instrument parabolic antenna or a level measuring instrument with such an antenna.

This task is accomplished by means of a level measuring instrument parabolic antenna with the characteristics of claim 1 or by a level measuring instrument with the characteristics of claim 9.

Accordingly, the parabolic antenna of the level measuring instrument advantageously consists of a parabolic reflector with a parabolic reflector rim, with the rim of the parabolic reflector transitioning into an additional collar having an external collar rim. In addition, the parabolic antenna has an exciter or an exciter and/or receiver. It is to be emphasized that the parabolic reflector and the collar are configured as a single piece, transitioning gradually into one another, and that the exciter and/or receiver are/is located within an interior space enclosed by the parabolic reflector and/or the collar. The exciter and/or receiver are/is therefore located in the axial direction within the rim of the collar.

A level measuring instrument with a parabolic antenna wherein the exciter and/or receiver are located within the interior space formed by the parabolic reflector, the rim of the collar and the plane whose circumference is the rim of collar is accordingly advantageous.

Advantageous embodiments are the objects of the dependent claims.

A parabolic antenna wherein the exciter and/or receiver do not extend in the axial and frontal directions beyond the thusly-formed interior space is advantageous.

The exciter and/or receiver, which is partially located within the rim of the parabolic reflector, which rim constitutes the transition between the parabolic reflector and the collar, advantageously extends in part in the axial direction beyond the region of the rim of the parabolic reflector or respectively the dish-shaped flat parabolic reflector and into the space enclosed by the walls of the collar. I.e., a part of the exciter and/or receiver is located in the axial direction within the parabolic reflector and another part within the collar.

At least the interior surface of the collar is advantageously configured so that it is constituted of a material which absorbs the radiation from the exciter.

The parabolic reflector advantageously has a focal length to diameter ratio of less than 1, in particular less than or equal to 0.6. Ratios between 0.2 and 0.3, in particular in the range of approximately 0.27, are particularly preferred.

A parabolic antenna in which the parabolic reflector and the collar enclose an interior space which is covered by a radome, thus protectively covering the exciter and/or receiver, is advantageous.

In accordance with a preferred embodiment, the parabolic reflector and the collar are configured as a single piece, transitioning into one another at the rim of the parabolic reflector. In a simple embodiment, the parabolic reflector rim does not constitute a transition between two separate independent structural elements, but rather a transition in the geometrical shape of the wall from a concave parabolic reflector to, in particular, a straight collar wall extension. The collar is advantageously configured to be conical or cylindrical.

Figure 1:
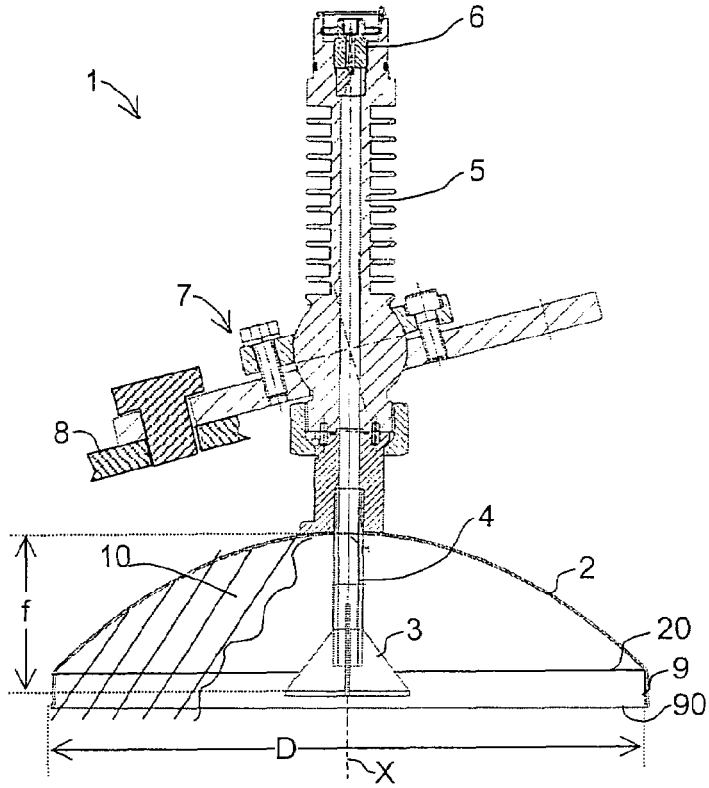

An embodiment is described in greater detail by means of the following drawings which show:

FIG. 1 a cross-section of an exemplary parabolic antenna;

FIG. 2 a cross-section of a parabolic antenna with a high focal length to diameter ratio in accordance with the state of the art;

FIG. 3 a cross-section of a parabolic antenna with a low focal length to diameter ratio; and FIG. 4 a schematic view of an antenna design from the telecommunications field.

FIG. 1 shows a cross-section of an exemplary parabolic antenna arrangement 1 of a level measuring instrument. The actual parabolic antenna consists of a parabolic reflector 2 with an encircling parabolic reflector rim 20. The parabolic reflector rim 20 transitions into an additional collar 9 with an external collar rim 90. The wall of the collar 9 advantageously extends approximately parallel to the central parabolic reflector axis X of the parabolic reflector 2. The parabolic antenna additionally comprises an exciter and/or a receiver 3, which are located on the parabolic reflector axis X and are distanced and located away from the back wall of the parabolic reflector 2 by means of a distancing, wave-conducting element, in particular an antenna conduit or a tubular conductor 4. The tubular conductor 4 changes in back into a wave guide device consisting of at least one wave guide 5, at whose rear end-section is located a connector 6 for a transmitter/receiver device. The transmitter/receiver device comprises electronics and components for producing an electromagnetic wave, in particular radar waves or microwaves. An emitted electromagnetic wave is transferred from the connector 6 through the wave guide 5 and the tubular conductor 4 to the exciter 3. The exciter 3 radiates the wave in the direction of the parabolic reflector and the wave is reflected by the latter in the direction parallel to the parabolic reflector axis X. After the electromagnetic wave which is emitted in this manner encounters a filling material or another suitable surface, the wave is reflected by the filling material or the top of the surface and is usually at least partly received by the parabolic reflector 2. The wall of the parabolic reflector 2 reflects the back-reflected wave components to the receiver 3 of the exciter and receiver device 3. The received wave is transferred by the receiver 3 via the tubular conductor 4, the wave guide 5 and the connector 6 to the receiver of the transmitting/receiving device and is captured by the latter. The electronics of the transmitting/receiving device or of a further attached evaluation device determine the time difference between the transmission of the electromagnetic wave and reception of the electromagnetic wave reflected by the filling material or the surface. This allows the level of the filling material in a container to be determined.

For purposes of attaching the parabolic antenna 1 to a container wall, in particular a container flange, the back components in the region of the wave guide 5 are, in an inherently known manner, equipped with an attachment device 7, e.g. a flange. The location of the exciter and/or receiver 3 is to be noted. The latter is placed far enough within the parabolic reflector 2 and collar 9 for the exciter and/or receiver 3 to be partly inside the parabolic reflector rim 20 and partly outside the parabolic reflector rim 20. I.e., a part extends into the region of the parabolic reflector 2 and a part sticks out into the space within the wall of the collar 9. The exciter and/or receiver 3 are thereby preferably located entirely inside the rim of collar 90. According to initial experiments with a typical exemplary antenna arrangement for a level measuring instrument, a focal length f to diameter D ratio for a still relatively flat reflector, for example with an f/D ratio of f/D=0.27, is preferred.

A thusly designed parabolic antenna combines the advantages of the various known parabolic antennas, but simultaneously avoids their disadvantages. Because the exciter 3 and/or the receiver 3 extends slightly beyond the parabolic reflector rim 20, for example by 10 mm, complete irradiation of the parabolic reflector 2 is ensured. By arranging for a collar with a cylindrical or conical shape, the exciter and/or receiver 3 are/is however completely located within the antenna system and thus protected. In addition, with full irradiation, side lobes and back lobes are prevented in the best possible way.

Furthermore, an integral single-piece configuration of the parabolic reflector 2 and the collar 9 is provided, with the parabolic reflector rim 20 constituting the transition region between them. The collar 9 can optionally consist of the same material as the parabolic reflector 2, or of another, different material. It is in particular possible to use an interior coating or all of the collar material for purposes of absorbing the electromagnetic waves which impinge on the inner wall of the collar 9.

The preferred parabolic antenna with the additional collar 9 attached as a widened antenna rim thus offers numerous advantages in comparison with a conventional parabolic antenna system. The emission of electromagnetic waves to the side (side lobes) and to the rear (back lobes) is suppressed. Since fewer interfering reflections are detected at close range, this provides considerable advantages, particularly in using this parabolic antenna in a level measuring device for measuring levels in narrow containers.

It is also advantageous that this provides for smaller irradiation losses. The exciter can be positioned so that the entire parabolic reflector 2 is irradiated, without being over-irradiated. A further advantage lies in the fact that risk of damage of the exciter and/or receiver 3 in case of transportation or during assembly is significantly reduced by its placement within the reflector arrangement. The use of this parabolic reflector with the collar around the exciter and/or receiver in a container also offers other advantages, for example in filling the container from the side, since the external wall of the parabolic reflector and the collar provides protection of the exciter and/or receiver 3 against damage by the filling material.

The complete antenna system can, if necessary, be advantageously covered or encased by a simple, planar protective covering, a so-called radome, for example, in the simplest case, a PTFE sheet (PTFE: polytetrafluoroethylene), or a vaulted covering. It is in particular possible to cover the interior space enclosed by the parabolic reflector 2 and the collar 9.

Such a parabolic antenna advantageously makes possible a short design, particularly in the axial direction of the parabolic reflector axis X, and thus a small dead spot in level measurements.

Initial experiments show that the configuration of such a parabolic antenna with different ratios of focal length f to diameter D is advantageously achievable. Thus, no restriction on the aforementioned values is necessary.

In a further exemplary embodiment of this invention, the interior of the parabolic antenna can be filled with a dielectric material. This leads to pressure support of the radome. The value of the dielectric constant of the dielectric material should be less than about 3. A foamed-up, low-loss material, e.g. Eccostock-Lok from the Emerson & Cuming Company, with a dielectric constant of 1.7 is preferably used for this purpose. FIG. 1 shows the filling 10 of the parabolic antenna.

SYMBOL REFERENCE LIST

1 Parabolic antenna arrangement
2 Parabolic reflector
20 Rim of the parabolic reflector
3 Exciter and/or receiver
4 Tubular conductor
5 Wave guide
6 Connector for the transmitting/receiving device
7 Attachment device/flange
8 Container flange
9 Collar at 20
10 Dielectric material
90 Outside rim of the collar
X Parabolic reflector axis
D Diameter of 20
f Focal length

The invention claimed is:

1. Parabolic antenna of level measuring instrument with a parabolic reflector (2) having a parabolic reflector rim (20);

a collar (9), which is positioned on the parabolic reflector (2) and has an outside collar rim (90);

an exciter and/or receiver (3), configured so that the parabolic reflector (2) and the collar (9) transition into one another as a single piece and the exciter and/or receiver (3) located within the interior space enclosed by the parabolic reflector (2) and/or the collar (9);

the exciter and/or receiver (3) situated in an axial direction (X) partly within a parabolic reflector rim (20) constituting the transition between the parabolic reflector (2) and the collar (9), and partly outside of the parabolic reflector rim (20), and the exciter and/or receiver (3) positioned so the exciter and/or receiver (3) extend axially in a forward direction (X), but do not extend beyond the parabolic reflector (2) and collar (9).

2. Parabolic antenna according to claim 1, wherein the collar (9) is, at least on its interior, equipped with a material that absorbs the waves from the exciter.

3. Parabolic antenna according to claim 1, wherein the parabolic reflector (2) has a focal length (f) to diameter (D) ratio (f/D) of between 0.2 and 0.3.

4. Parabolic antenna according to claim 1, wherein the parabolic reflector (2) has a focal length (f) to diameter (D) ratio of approximately 0.27.

5. Parabolic antenna according to claim 1, wherein the parabolic reflector (2) and the collar (9) enclose an interior space, which is covered by a radome.

6. Parabolic antenna of a level measuring instrument according to claim 5, wherein the interior of the parabolic antenna is filled with a dielectric material.

7. Parabolic antenna according to claim 1, wherein the collar (9) is of a conical or cylindrical shape.

8. Level measuring instrument with a level measuring instrument parabolic antenna according to claim 1.

9. Parabolic antenna according to claim 1, wherein the parabolic reflector (2) has a focal length (f) to diameter (D) ratio (f/D) less than 1.

10. Parabolic antenna according to claim 1, wherein the parabolic reflector (2) has a focal length (f) to diameter (D) ratio (f/D) less than or equal to 0.6.

11. Parabolic antenna according to claim 1, wherein the parabolic reflector (2) has a focal length (f) to diameter (D) ratio of 0.2 to 0.3.

* * * * *